US012054304B2

(12) United States Patent
Demmink et al.

(10) Patent No.: US 12,054,304 B2
(45) Date of Patent: Aug. 6, 2024

(54) RECLOSABLE PLASTIC BOTTLE WITH WAIST AND STRENGTHENING RIB(S)

(71) Applicant: Abbott Laboratories, Abbott Park, IL (US)

(72) Inventors: Kyle W. Demmink, Westerville, OH (US); Timothy J. Boyd, Delaware, OH (US); Jay Z. Yuan, Mason, OH (US); Xinzhong Zhang, Mason, OH (US); James P. Perry, Gahanna, OH (US); Jameel Ahmed, Hilliard, OH (US)

(73) Assignee: ABBOTT LABORATORIES, Abbott Park, IL (US)

( * ) Notice: Subject to any disclaimer, the term of this patent is extended or adjusted under 35 U.S.C. 154(b) by 2 days.

(21) Appl. No.: 17/832,138

(22) Filed: Jun. 3, 2022

(65) Prior Publication Data

US 2023/0391491 A1 Dec. 7, 2023

(51) Int. Cl.

| | |
|---|---|
| ***B65D 1/44*** | (2006.01) |
| ***B65D 1/02*** | (2006.01) |
| ***B65D 65/16*** | (2006.01) |
| ***B65D 85/72*** | (2006.01) |

(52) U.S. Cl.

CPC ..... *B65D 1/44* (2013.01); *B65D 1/0223* (2013.01); *B65D 1/0276* (2013.01); *B65D 65/16* (2013.01); *B65D 85/72* (2013.01); *B65D 2501/0036* (2013.01)

(58) Field of Classification Search

CPC .... B65D 2501/0036; B65D 1/42; B65D 1/44; B65D 65/16; B65D 65/8572; B65D 1/0223

See application file for complete search history.

(56) References Cited

U.S. PATENT DOCUMENTS

| | | | |
|---|---|---|---|
| 5,054,632 | A | 10/1991 | Alberghini et al. |
| 5,704,504 | A | 1/1998 | Bueno |
| 7,347,339 | B2 | 3/2008 | Bangi et al. |

(Continued)

FOREIGN PATENT DOCUMENTS

| | | |
|---|---|---|
| EP | 1627821 | 5/2007 |
| EP | 1638849 | 8/2007 |

(Continued)

OTHER PUBLICATIONS

US 11,084,631 B2, 08/2021, Smith (withdrawn)
International Search Report and Written Opinion for PCT/US2023/67869, mailed Sep. 21, 2023, 11 pages.

*Primary Examiner* — Nathan J Jenness
*Assistant Examiner* — Jennifer Castriotta
(74) *Attorney, Agent, or Firm* — McAndrews, Held & Malloy, Ltd.

(57) ABSTRACT

The present disclosure is directed to a bottle made of polyethylene terephthalate (PET) and having a circular cross-section. The bottle has a sidewall spanning between a neck finish and a base. The sidewall includes a shoulder portion and a panel portion, with the lower end of the shoulder portion and the upper end of the panel portion each sloping inward to create a waist. One or more circumferential ribs are positioned within the waist, and preferably at the trough of the waist. The one or more circumferential ribs are designed and configured to increase the hoop strength of the bottle, the vacuum stability of the bottle, or both.

18 Claims, 11 Drawing Sheets

(56) References Cited

U.S. PATENT DOCUMENTS

| | | | | |
|---|---|---|---|---|
| 7,416,089 | B2 | 8/2008 | Kraft et al. | |
| 7,673,765 | B2 * | 3/2010 | Pritchett, Jr. | B65D 1/0223 215/381 |
| 7,832,582 | B2 | 11/2010 | Roubal et al. | |
| 7,837,049 | B2 | 11/2010 | Boukobza | |
| 7,918,356 | B2 | 4/2011 | Penny | |
| D653,951 | S * | 2/2012 | Scott | D9/502 |
| 8,141,741 | B2 * | 3/2012 | Metzger | B65D 7/46 220/672 |
| 8,393,483 | B2 | 3/2013 | Druitt | |
| 8,496,130 | B2 * | 7/2013 | Lane | B65D 79/0084 215/381 |
| 8,820,555 | B2 | 9/2014 | Tanaka et al. | |
| 9,314,956 | B2 | 4/2016 | Porter et al. | |
| 9,884,705 | B2 | 2/2018 | Wood et al. | |
| 9,896,254 | B2 * | 2/2018 | Yourist | B65D 23/102 |
| 10,059,482 | B2 | 8/2018 | Mast et al. | |
| 10,086,970 | B2 | 10/2018 | Gutekunst et al. | |
| 10,407,220 | B2 | 9/2019 | Neputy | |
| 10,532,858 | B2 | 1/2020 | Druitt | |
| 10,647,492 | B2 | 5/2020 | Swenson et al. | |
| 10,723,519 | B2 | 7/2020 | Edie et al. | |
| 10,766,683 | B2 | 9/2020 | Pritchett, Jr. et al. | |
| 10,889,402 | B2 | 1/2021 | Florez-Bedoya et al. | |
| 11,117,701 | B2 | 9/2021 | Heisner et al. | |
| 11,261,002 | B2 * | 3/2022 | Kira | B65D 79/005 |
| 2010/0140280 | A1 * | 6/2010 | Burke | B29C 49/0005 220/660 |
| 2012/0000882 | A1 | 1/2012 | Castillo Higareda | |
| 2012/0061410 | A1 | 3/2012 | Kamineni et al. | |
| 2014/0183156 | A1 | 7/2014 | Hanan | |
| 2015/0122766 | A1 | 5/2015 | Hanan | |
| 2018/0297752 | A1 | 10/2018 | Mai | |
| 2019/0315545 | A1 | 10/2019 | Melrose | |
| 2019/0389616 | A1 | 12/2019 | Heisner et al. | |
| 2020/0002045 | A1 | 1/2020 | Kira et al. | |
| 2020/0031530 | A1 | 1/2020 | Hanan | |
| 2020/0087045 | A1 | 3/2020 | Laine et al. | |
| 2020/0189805 | A1 | 6/2020 | Scherer et al. | |
| 2020/0216213 | A1 | 7/2020 | Hanan | |
| 2021/0229888 | A1 | 7/2021 | Dygert et al. | |
| 2022/0324604 | A1 | 10/2022 | Boyd et al. | |

FOREIGN PATENT DOCUMENTS

| | | |
|---|---|---|
| EP | 2145827 | 8/2011 |
| EP | 2289809 | 4/2012 |
| EP | 2648983 | 3/2016 |
| EP | 2285699 | 11/2016 |
| EP | 2990349 | 9/2017 |
| EP | 3048059 | 2/2018 |
| EP | 3145822 | 2/2022 |
| WO | 2007032545 | 3/2007 |
| WO | 2018047711 | 3/2018 |
| WO | 2020007832 | 1/2020 |
| WO | 2020028424 | 2/2020 |
| WO | 2020041526 | 2/2020 |
| WO | 2020101672 | 5/2020 |
| WO | 2020179607 | 9/2020 |
| WO | 2021010779 | 1/2021 |
| WO | 2022182833 | 9/2022 |

* cited by examiner

RECLOSABLE PLASTIC BOTTLE WITH WAIST AND STRENGTHENING RIB(S)

BACKGROUND

Polyethylene terephthalate (PET) is a common material for consumer packages, both rigid and flexible. More particularly, PET is widely used to make plastic bottles, such as those configured to hold beverages. Though PET is a highly recyclable material, making it desirable for use in plastic bottles, it is fairly limited in terms of strength. The present disclosure relates to a reclosable plastic bottle prepared from PET and having a central waist and one or more ribs configured to provide the bottle, and more particularly the central waist, with enhanced strength.

SUMMARY OF THE INVENTION

Embodiments of the present disclosure are directed to a PET bottle comprising a neck finish, a base, and sidewall spanning between the neck finish and the base. The sidewall has a circular cross-section (taken perpendicular to the longitudinal axis of the bottle). The sidewall comprises an upper shoulder portion and a lower panel portion. A lower end of the shoulder portion slopes and an upper end of the panel portion both slope inward to create a waist. The waist may be at or near a center of the bottle, measured between the base and the upper edge of the neck finish. The bottle may also comprise one or more circumferential ribs positioned within the waist, for instance at the trough of the waist, the one or more circumferential ribs being configured to provide a significant increase in at least a hoop strength and a vacuum stability of the bottle.

In some embodiments, the bottle may have a single circumferential rib within the waist, for instance with the single circumferential rib being positioned at the trough of the waist. The single circumferential rib may have a width between 0.13 and 0.22 inches and a depth between about 0.080 and about 0.110 inches, optionally a width between about 0.14 and about 0.21 inches and a depth between about 0.081 inches and about 0.100 inches, optionally a width between about 0.15 and about 0.20 inches and a depth between about 0.082 inches and about 0.090 inches. In some instances the use of a single rib may be desirable for the overall aesthetics of the bottle, which may for example be provided with a shrink label that has a cleaner appearance when applied to a smooth surface. Also, or alternatively, the use of only a single rib may be desirable in some instances because smooth, uniform surfaces facilitate the evacuation of sterilizing medium during an aseptic filling process.

In some embodiments, the bottle may have two circumferential ribs within the waist, the two circumferential ribs being separated by a land. The two circumferential ribs and separating land may be positioned at the trough of the rib, e.g. with the land being at the substantial middle of the waist. Each of the two circumferential ribs may have a width between about 0.08 inches and about 0.15 inches and a depth between about 0.064 and about 0.086 inches. The separating land may have a width between about 0.13 and about 0.34 inches. In some embodiments the separating land may be continuously curved, though in other embodiments the separating land may comprise a flat or substantially flat outer portion. In some instances the use of two ribs may be desirable, as the higher number of ribs generally produces greater enhancements in hoop strength and vacuum stability compared to a bottle having only a single rib in the waisted region of the bottle.

The bottles of the present disclosure may be configured to have long-term vacuum stability, such that the bottle will be expected to maintain its shape over the shelf-life of a product contained therein. For example, in some embodiments the one or more ribs in the waisted region of the bottle may be effective to provide the bottle with a 15-month vacuum safety factor greater than 1.0, optionally a 15-month vacuum safety factor of at least 1.05, optionally at least 1.10, optionally at least 1.15, optionally at least 1.20, determined as described herein and with a 0.1 inch or higher ovality being considered an unacceptable level of deformation. Similarly, in some embodiments the one or more ribs in the waisted region of the bottle may be effective to provide the bottle with an 18-month vacuum safety factor greater than 1.0, optionally an 18-month vacuum safety factor of at least 1.05, optionally at least 1.10, optionally at least 1.15, optionally at least 1.20, determined as described herein and with a 0.1 inch or higher ovality being considered an unacceptable level of deformation.

The bottles of the present disclosure may be configured such that the waisted region of the bottle has at least a minimum hoop strength. For instance, the one or more ribs may be effective to provide the bottle with a waist hoop strength of at least 15.0 lbf, optionally at least 17.5 lbf, optionally at least 20.0 lbf, optionally at least 22.5 lbf, optionally at least 25.0 lbf, optionally at least 27.5 lbf, as determined by the hoop strength testing protocols described herein.

Embodiments of the bottle described herein may be formed of a single layer of PET, i.e. embodiments of the bottles described herein may be monolayer PET bottles. The monolayer of PET may comprise an oxygen scavenger of the sort that are known and provided for use in PET packaging, as would be understood by a person of ordinary skill in the art. The concentration of the oxygen scavenger may be selected to provide the bottle with a desired water vapor transmission rate (WVTR). In some embodiments, the monolayer PET bottles may contain an oxygen scavenger in an amount between about 0.5% and about 5% of the total weight of the PET, optionally between about 1% and about 4% of the total weight of the PET. The specific concentration of the oxygen scavenger in the PET material may vary depending on the identity of the oxygen scavenger. In other embodiments, the bottles may be made of a multilayer PET material.

In some embodiments, the bottle may have a water vapor transmission rate less than 0.019 g/pkg-day, optionally less than 0.018 g/pkg-day, optionally less than 0.017 g/pkg-day, optionally less than 0.016 g/pkg-day, optionally less than 0.015 g/pkg-day, optionally less than 0.014 g/pkg-day, optionally less than 0.013 g/pkg-day, optionally less than 0.012 g/pkg-day.

In some embodiments, the bottle may have a product fill volume between six ounces and eleven ounces, optionally the bottle has a product fill volume of about eight ounces. In some embodiments, the bottles of the present disclosure may be filled. For example in some embodiments the bottles of the present disclosure may be filled with a nutritional liquid composition.

In some embodiments, the bottle may have a weight between about 16 g and about 21 g, optionally between about 17 g and about 20 g, optionally between about 18 g and about 19 g.

In some embodiments, the sidewall of the bottle may have an average thickness between about 0.008 inches and about 0.016 inches, optionally between about 0.009 inches and about 0.015 inches, optionally between about 0.010 inches and about 0.014 inches.

The sidewall of the PET bottle may have a maximum diameter. In some embodiments, both the upper shoulder portion (above the waist) and the lower panel portion (below the waist) may extend outward to the maximum diameter of the bottle. In some embodiments, the maximum diameter of the bottle may be between about 55 mm and about 62 mm. In comparison, the diameter of the bottle sidewall at an innermost point of the one or more circumferential ribs positioned within the waisted region may be between about 43 mm and about 50 mm. In some embodiments, the ratio of the maximum diameter of the shoulder and panel portions to the diameter at an innermost point of the one or more circumferential ribs may be between about 1.1:1 and about 1.4:1, alternatively between about 1.2:1 and about 1.3:1.

The base of the PET bottle may comprise a standing ring and a central push-up portion. In some embodiments, the central push-up portion may be a smooth curve, containing no ribs or other strength-providing surface features. In other embodiments, the central push-up portion may comprise a petaloid structure. For example, the central push-up portion may comprise a plurality of insets that extend into the interior space of the bottle. The central push-up portion may be configured to flex inward in response to a reduction of pressure within the bottle and/or to flex outward in response to an increase of pressure within the bottle relative to ambient. The height of the central push-up portion above the standing ring may be configured to ensure that in response to any internal pressure increase that may reasonably be encountered during the life cycle of the product, the push-up portion will not extend beyond the standing ring, which would give rise to a lack of bottle stability. In some embodiments, for example, the central push-up portion may extend between about 4 mm and about 6 mm upward from the standing ring.

In some embodiments, apart from the one or more circumferential ribs positioned within the waisted region of the sidewall, the sidewall of the PET bottle may be free of additional strengthening ribs, vacuum panels, or the like. For instance, both the upper shoulder portion and the lower panel portion of the bottle sidewall may be free of additional strengthening ribs, vacuum panels, or the like. This may particularly be the case for PET bottles having relatively small internal volumes, for example a bottle having a product fill volume of six ounces. In other embodiments, the lower panel portion of the bottle sidewall may comprise one or more circumferential ribs.

In some embodiments, for example, the panel portion of the sidewall may comprise one or more circumferential ribs below the waist. Because it may be desirable to limit the number of circumferential ribs present on the panel portion of the sidewall, embodiments of the PET bottle may have only a single circumferential rib below the waist on the panel portion of the sidewall. As in the illustrated embodiment, for example, a bottle having a product fill volume of about eight ounces may comprise a single circumferential rib on the panel portion of the sidewall. In other embodiments, such as for PET bottles having relative large internal volumes, for example a bottle having a product fill volume of between ten and twelve ounces, and thus a panel portion that spans a larger vertical distance, the panel portion of the sidewall may comprise multiple, e.g. two, circumferential ribs.

The one or more circumferential ribs positioned on the sidewall below the waist may be configured to provide the PET bottle with enhanced strength without significantly affecting the overall appearance of the bottle. For instance, the one or more circumferential ribs positioned on the sidewall below the waist may each be dimensionally smaller than the one or more circumferential ribs positioned in the waisted region of the sidewall. For instance, each circumferential rib on the panel portion of the bottle sidewall may have a rib width less than the rib width of the one or more circumferential ribs positioned at the waist, a rib depth less than the rib depth of the one or more circumferential ribs positioned at the waist, or both. In some embodiments, for instance, each of the one or more circumferential ribs below the waist may have a rib width less than 0.15 inches, optionally less than 0.12 inches, optionally less than 0.10 inches, and a rib depth less than 0.086 inches, optionally less than 0.076 inches, optionally less than 0.070 inches.

Apart from the one or more circumferential ribs positioned at the waist and the one or more circumferential ribs on the panel portion below the waist, the sidewall of the PET bottle may be free of additional strengthening ribs, vacuum panels, or the like. In this way, the majority of the bottle sidewall may comprise a smooth surface.

Embodiments of the present disclosure are also directed to a product, for instance a liquid nutritional product, which comprises the PET bottle of any embodiment disclosed herein, a liquid nutritional product contained within the bottle, and a removable plastic cap, the removable plastic cap forming an air-tight seal with the finish of the bottle. In some embodiments, the product may also comprise a shrink sleeve label which covers at least the sidewall of the bottle, and which may more particularly cover an entirety of the bottle sidewall and optionally a portion of the removable plastic cap. The shrink sleeve label may, in some embodiments, such as where the liquid nutritional product may be sensitive to light, be configured to protect the liquid nutritional product from external light.

BRIEF DESCRIPTION OF THE DRAWINGS

A clear conception of the advantages and features of one or more embodiments will become more readily apparent by reference to the exemplary, and therefore non-limiting, embodiments illustrated in the drawings.

DETAILED DESCRIPTION OF THE INVENTION

Figure 1:
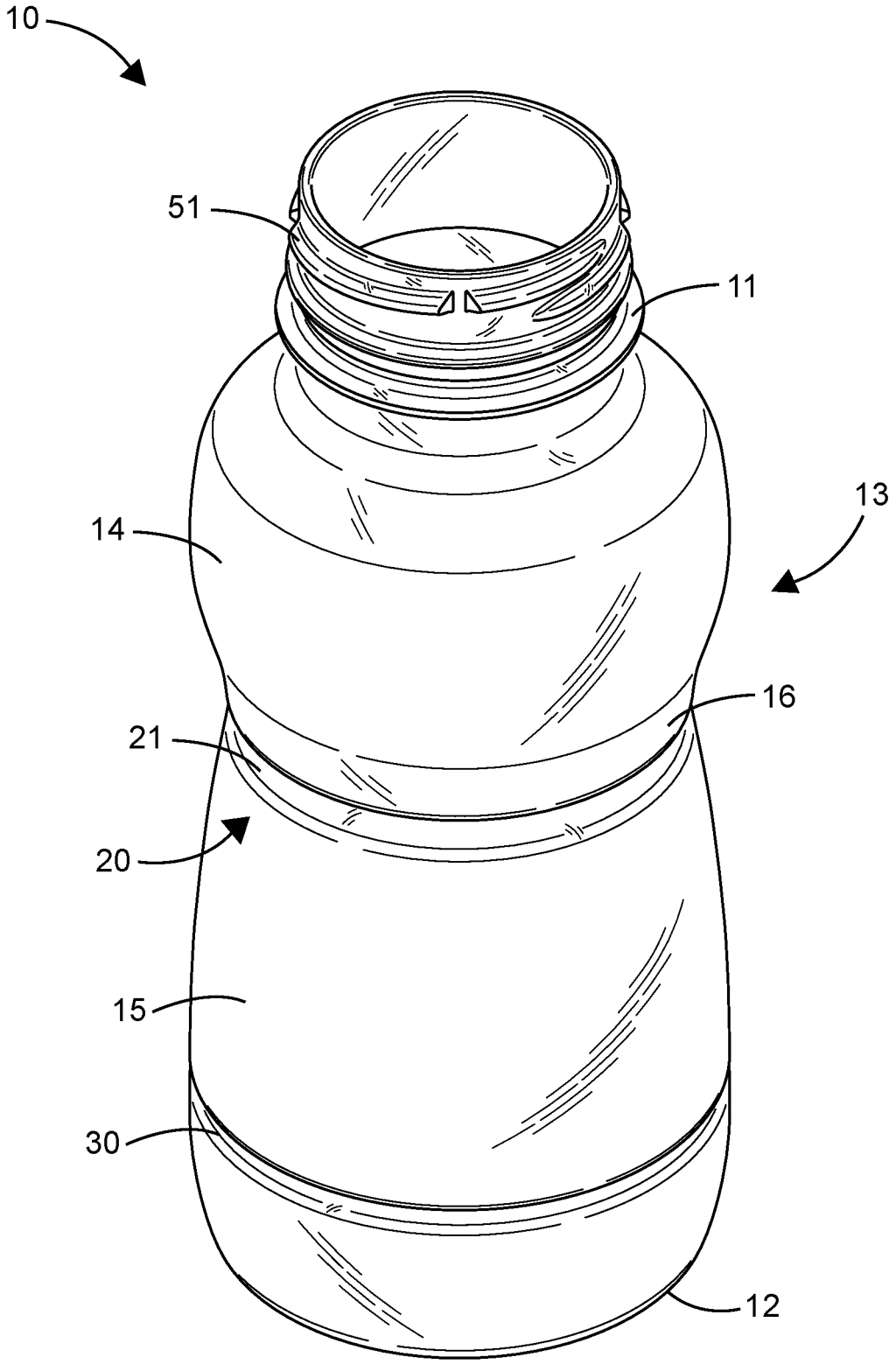
FIG. 1 is an upper perspective view of a first embodiment of a bottle in accordance with the present disclosure.

Embodiments of the present disclosure are directed to a bottle produced from polyethylene terephthalate (PET). The bottle may be produced by known methods, such as by blow molding of a preform. The bottle may also be filled with a liquid food product, e.g. a liquid nutritional product, by known methods such as aseptic filling. The bottle may be sealed with a reclosable cap (not shown), e.g. a plastic cap having an thread pattern on an interior surface of a sidewall that corresponds with the external threads on the neck of the bottle. The plastic cap may be configured to sealingly engage the upper edge of the bottle, to provide a gas-tight and liquid-tight seal. This may be achieved in a variety of ways, including by a plug-type, direct seal in which the wall of the bottle neck is compressed between a flexible inner sealing element and an outer sealing element (each of which may extend downward from an underside of the cap), or the interaction of a gasket provided on the underside of the cap with the upper edge of the bottle neck.

In some embodiments, the PET bottle may be a monolayer PET bottle, meaning that the preform, and thus the bottle, consists of a single layer of PET. In embodiments where the content of the bottle are sensitive to oxygen, the PET may comprise an oxygen scavenger, which are generally known and sold commercially under a variety of trade names. The concentration of the oxygen scavenger may depend both on the degree of protection desired and the identity of the specific oxygen scavenger that is selected. In some embodiments, the oxygen scavenger may be present in an amount between about 1% and about 4% of the total weight of the PET. In other embodiments, the PET bottle may comprise multiple layers of PET. For instance, the preform, and thus the bottle, may comprise one or more layers of PET comprising oxygen scavenger and one or more layers of pure or substantially pure PET.

In some embodiments, the PET bottle may include one or more oxygen scavengers in an amount sufficient to provide the bottle with a water vapor transmission rate less than 0.0185 g/pkg-day, alternatively less than 0.0170 g/pkg-day, alternatively less than 0.0150 g/pkg-day, alternatively less than 0.0130 g/pkg-day, alternatively less than 0.0120 g/pkg-day.

The bottle may be provided with dimensions sufficient to have an interior product fill volume (as well as a small headspace, as would generally be understood by one of skill in the art) between six ounces and eleven ounces, optionally between six ounces and ten ounces. Embodiments of the bottle may be configured to have a product fill volume of six ounces, alternatively seven ounces, alternatively eight ounces, alternatively nine ounces, alternatively ten ounces, alternatively eleven ounces.

In some embodiments, for example, the bottle height (measured from the standing surface to the upper edge of the neck) may be between about 125 mm and about 150 mm, alternatively between about 130 mm and about 145 mm; and the maximum bottle diameter may be between about 50 mm and about 70 mm, alternatively between about 50 mm and about 65 mm, alternatively between about 55 and about 65 mm, alternatively between about 55 mm and about 60 mm. In some embodiments, the waist diameter may be between about 45 mm and about 55 mm, alternatively between about 47 mm and about 53 mm (measured at the outer edges of the one or more ribs). In some embodiments, the neck diameter may be between about 30 mm and about 40 mm.

The bottle may also have a relatively low weight. Embodiments of the bottle may have a bottle weight between about 16 grams and about 21 grams, alternatively between about 17 grams and about 20 grams, alternatively between about 18 grams and about 19 grams.

The bottle may have a relatively thin sidewall. For instance, in some embodiments the sidewall may have an average thickness between about 0.008 inches and about 0.016 inches, alternatively between about 0.009 inches and about 0.015 inches, alternatively between about 0.010 inches and about 0.014 inches. While the relatively thin sidewall may serve to keep material costs and bottle weight low, it may be subject to deformation. Accordingly, the bottle may comprise one or more strength-providing ribs as is described herein.

An first embodiment of a PET bottle 10 in accordance with the present disclosure is illustrated in FIGS. 1-4 and a second embodiment of a PET bottle in accordance with the present disclosure is illustrated in FIGS. 5-8. The bottles shown in the illustrated embodiments have a product fill volume of weight ounces. Each of the illustrated bottles comprises a neck finish 11, a base 12, and a sidewall 13 that spans between the neck finish and the base. The sidewall is generally divided into a shoulder portion 14 and a panel portion 15 by a central waisted region, or waist 16. The bottle 10, and more particularly the sidewall 13, is generally of a circular cross-section, with the cross-section taken at any point along the longitudinal axis of the bottle.

Figure 2:
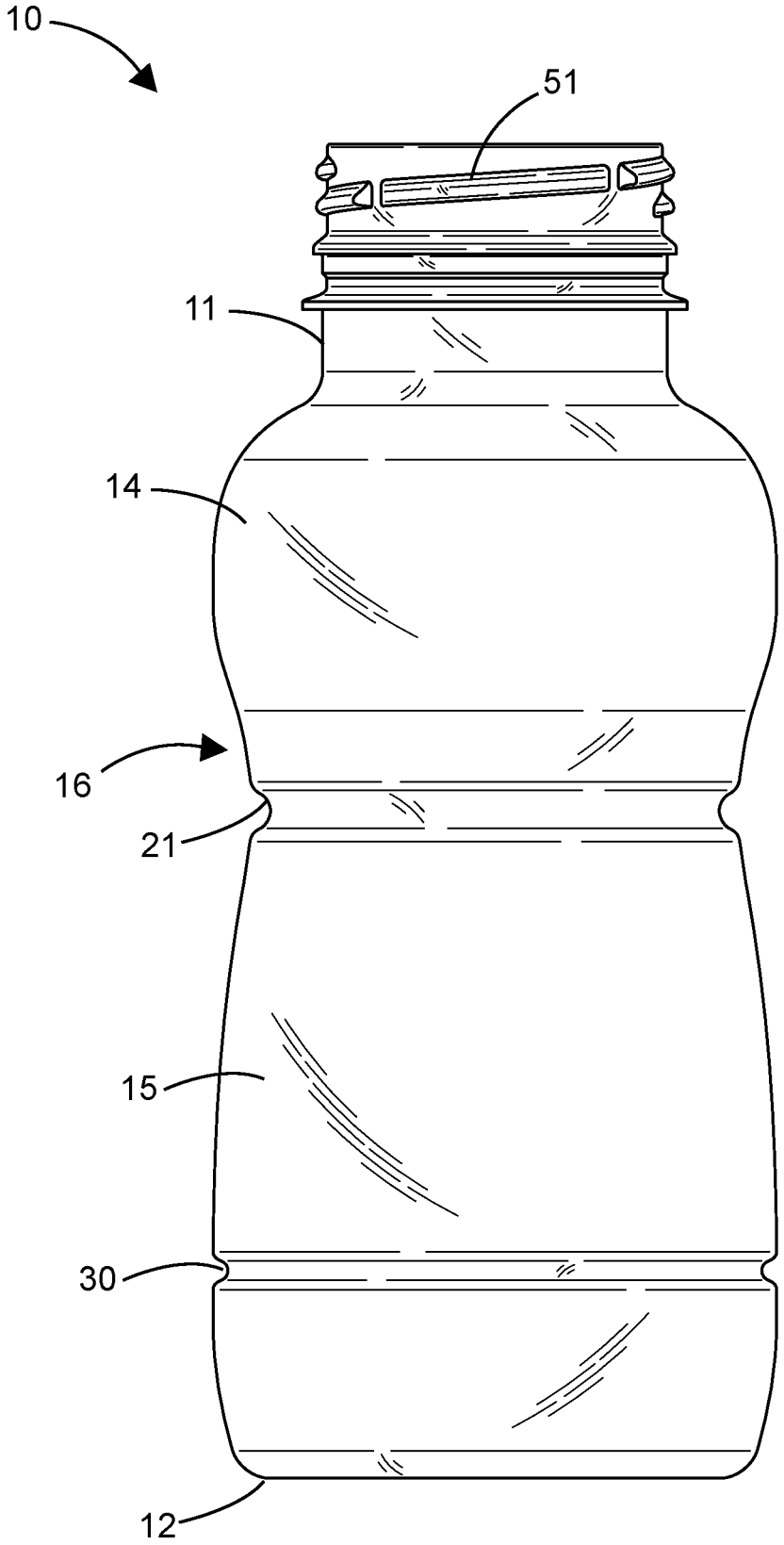
FIG. 2 is a front plan view of the embodiment shown in FIG. 1.
Figure 3:
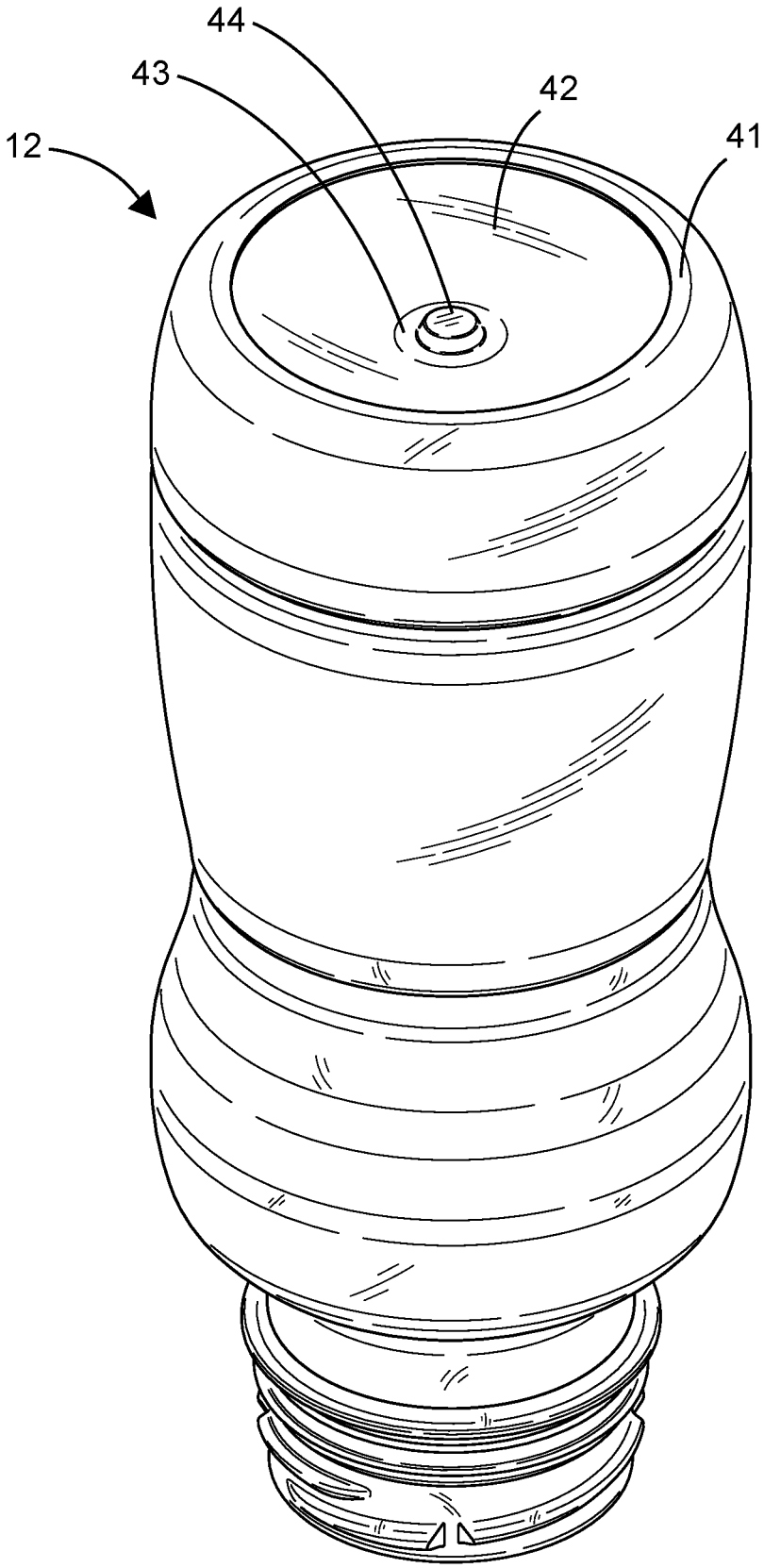
FIG. 3 is a lower perspective view of the embodiment shown in FIG. 1.
Figure 4:
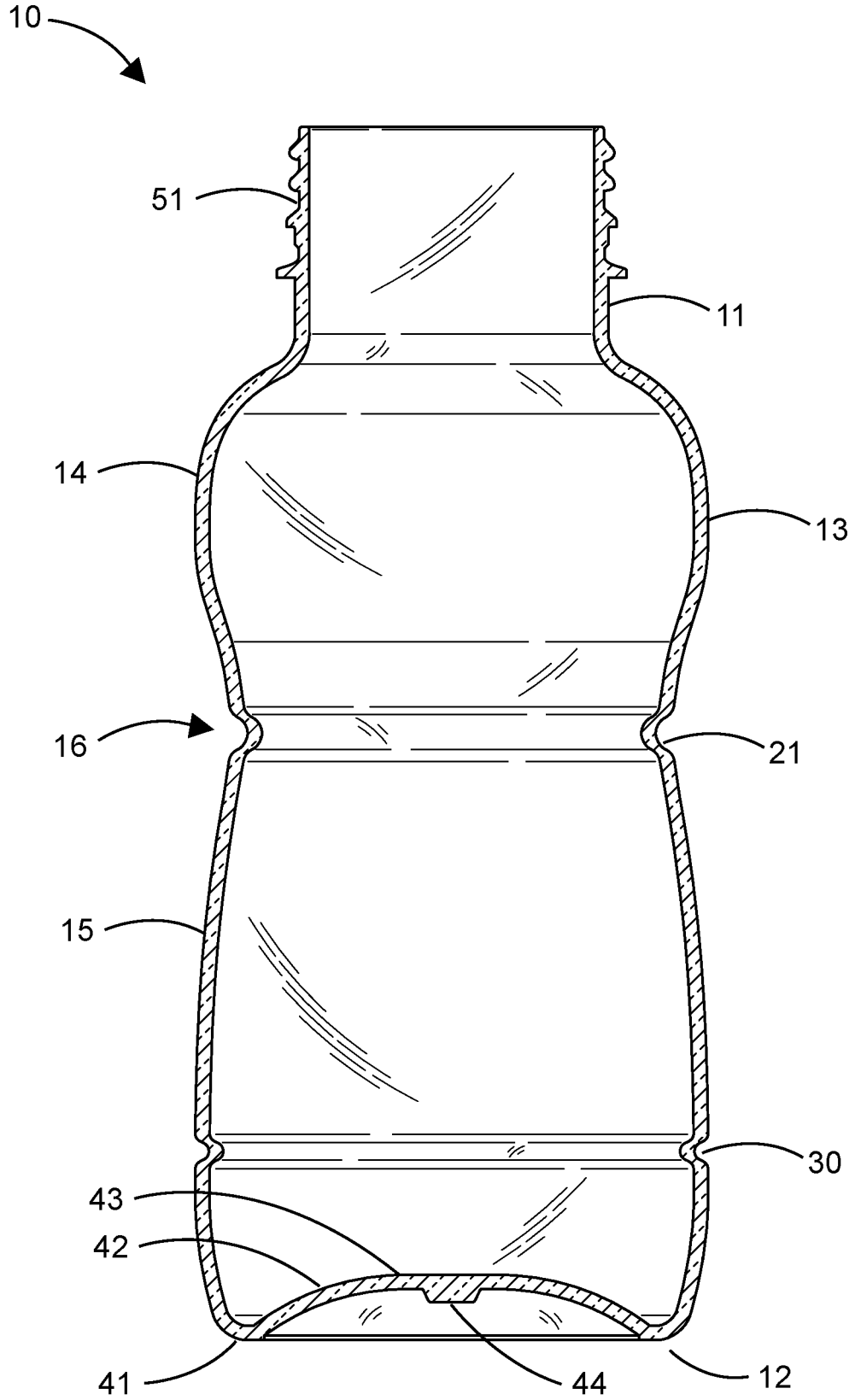
FIG. 4 is a cross-sectional view of the embodiment shown in FIG. 1, taken along the longitudinal axis of the bottle.
Figure 5:
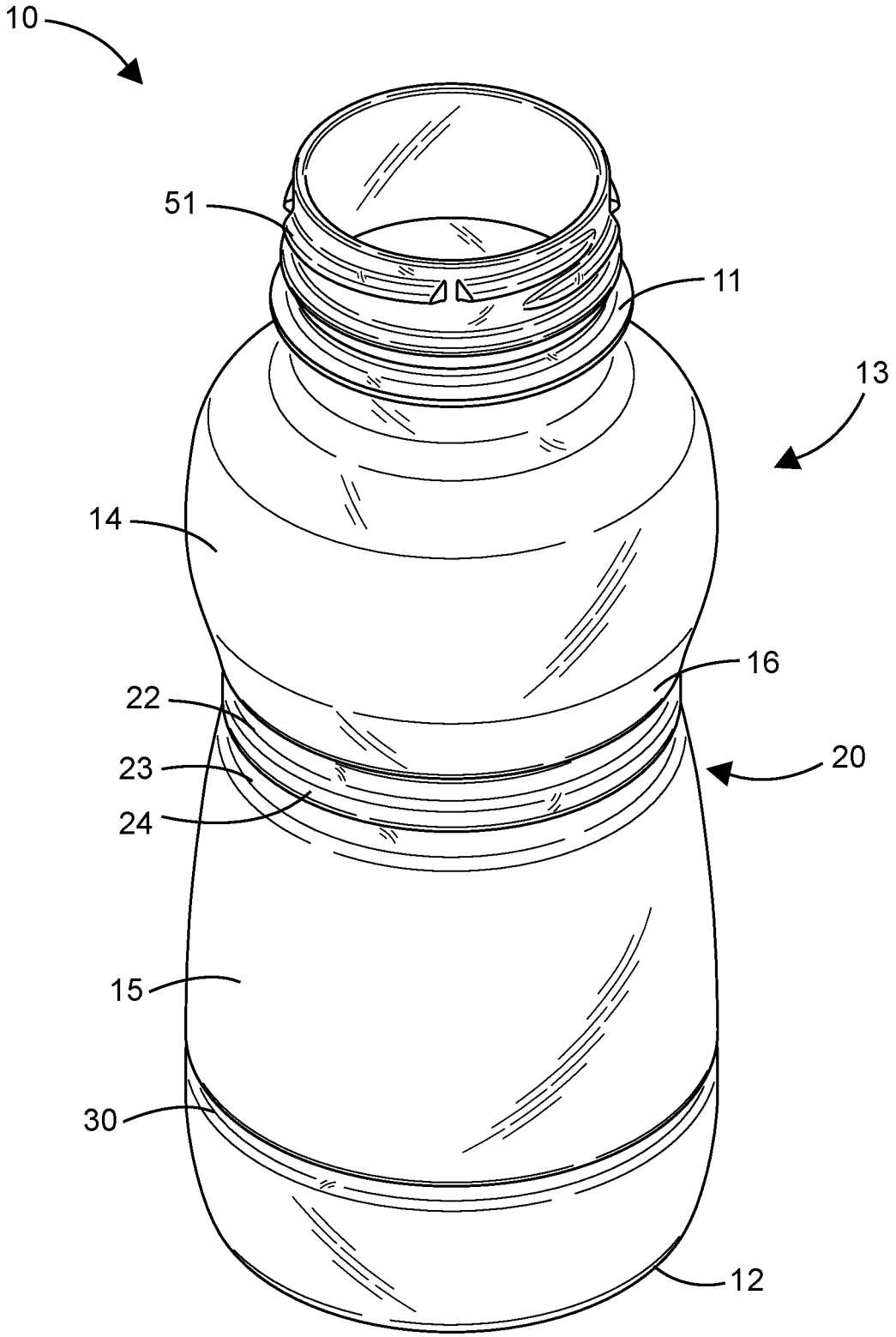
FIG. 5 is an upper perspective view of a second embodiment of a bottle in accordance with the present disclosure.

The shoulder portion 14 comprises an upper segment that transitions, desirably smoothly, into the neck portion of the bottle. For instance, the upper segment of the shoulder portion 14 may slope outward from the neck portion 11 of the bottle (at a neck diameter) to an outermost point of the shoulder portion (at a maximum shoulder diameter). The shoulder portion 14 also comprises a lower segment that slopes inward to—with the upper segment of the panel portion 15—create a waist 16. The lower segment of the shoulder portion 14 may, for example, extend from the outermost point of the shoulder portion (at a maximum shoulder diameter) to the uppermost edge of the one or more circumferential ribs positioned within the waist 16. As shown in FIG. 2, for example, the lower segment of the shoulder portion 14 may have a more gradual slope than the upper segment of the shoulder portion. Viewed in its entirety, the shoulder portion 14 may generally provide a convex surface having an outermost central region and inwardly directed upper and lower segments.

The panel portion 15 comprises a lower segment that transitions into the base portion 12 of the bottle, and more particularly into the standing ring of the base portion 12. For instance, the lower segment of the panel portion 15 may slope outward from the base portion 12 of the bottle (at a base diameter) to an outermost point of the panel portion (at a maximum panel diameter). The panel portion 15 also comprises an upper segment that slopes inward to—with the lower segment of the shoulder portion 14—create a waist 16. The upper segment of the panel portion 15 may, for example, extend from the outermost point of the panel portion (at a maximum panel diameter) to the lowermost edge of the one or more circumferential ribs positioned within the waist 16. As shown in FIG. 2, for example, the panel portion 15 may have a generally smooth curvature throughout most of its length, (this may be in contrast to the shoulder portion 14, in which the curvature of the upper segment and the curvature of the lower segment may be quite distinct from one another). Viewed in its entirety, the panel portion 15 may generally provide a very lightly convex surface having an outermost central region and inwardly directed upper and lower segments. As shown in the illustrated embodiments, the curvature at the central region of the panel portion 15 may be very slight, such that the outermost central region of the panel portion 15 may extend for a length.

In some embodiments, including the illustrated embodiments, the maximum shoulder diameter and the maximum panel diameter may be the same or substantially the same. In such embodiments, the maximum shoulder diameter and the maximum panel diameter may represent the maximum diameter of the bottle. In some embodiments, the maximum diameter of the bottle may be between about 55 mm and about 62 mm. For example, the maximum diameter of the illustrated embodiments is about 58 mm.

As shown in the illustrated embodiments, the bottle 10 further comprises one or more circumferential ribs 20 positioned within the waist 16, and preferably at the trough of the waist (i.e., the waist does not continue inward from the one or more ribs). The one or more circumferential ribs 20 may be configured to increase the hoop strength and the vacuum stability of the bottle 10, as described herein.

In the embodiment illustrated in FIGS. 1 to 4, the bottle 10 comprises a single circumferential rib 21. As described herein, the rib width and rib depth may be selected to provide the bottle with a desired waist hoop strength and/or vacuum stability. In some embodiments, for instance, the circumferential rib may have a width between about 0.13 and about 0.22 inches and a depth between about 0.080 and about 0.110 inches, alternatively a width between about 0.14 and about 0.21 inches and a depth between about 0.081 inches and about 0.100 inches, alternatively a width between about 0.15 and about 0.20 inches and a depth between about 0.082 inches and about 0.090 inches.

In some embodiments, the circumferential rib 21 may also have a radius of curvature between about 1.15 mm and about 1.45 mm, alternatively between about 1.20 mm and about 1.40 mm, alternatively between about 1.22 mm and about 1.35 mm, alternatively between about 1.25 mm and about 1.30 mm.

In the embodiment illustrated in FIGS. 5 to 8, the bottle 10 comprises two circumferential ribs: a first circumferential rib 22 and a second circumferential rib 23. The first and second circumferential ribs 22, 23 are separated by a land 24. As described herein, the width and depth of each of the first and second ribs 22, 23 may be selected to provide the bottle with a desired waist hoop strength and/or vacuum stability. In some embodiments, for instance, each of the first and second circumferential ribs 22, 23 may have a width between about 0.08 inches and about 0.15 inches and a depth between about 0.064 and about 0.086 inches. In some embodiments, including the illustrated embodiment for example, the first and second circumferential ribs 22, 23 have substantially identical widths and depths.

In some embodiments, each of the first and second circumferential ribs 22, 23 may also have a radius of curvature between about 1.15 mm and about 1.45 mm, alternatively between about 1.20 mm and about 1.40 mm, alternatively between about 1.22 mm and about 1.35 mm, alternatively between about 1.25 mm and about 1.30 mm.

Figure 6:
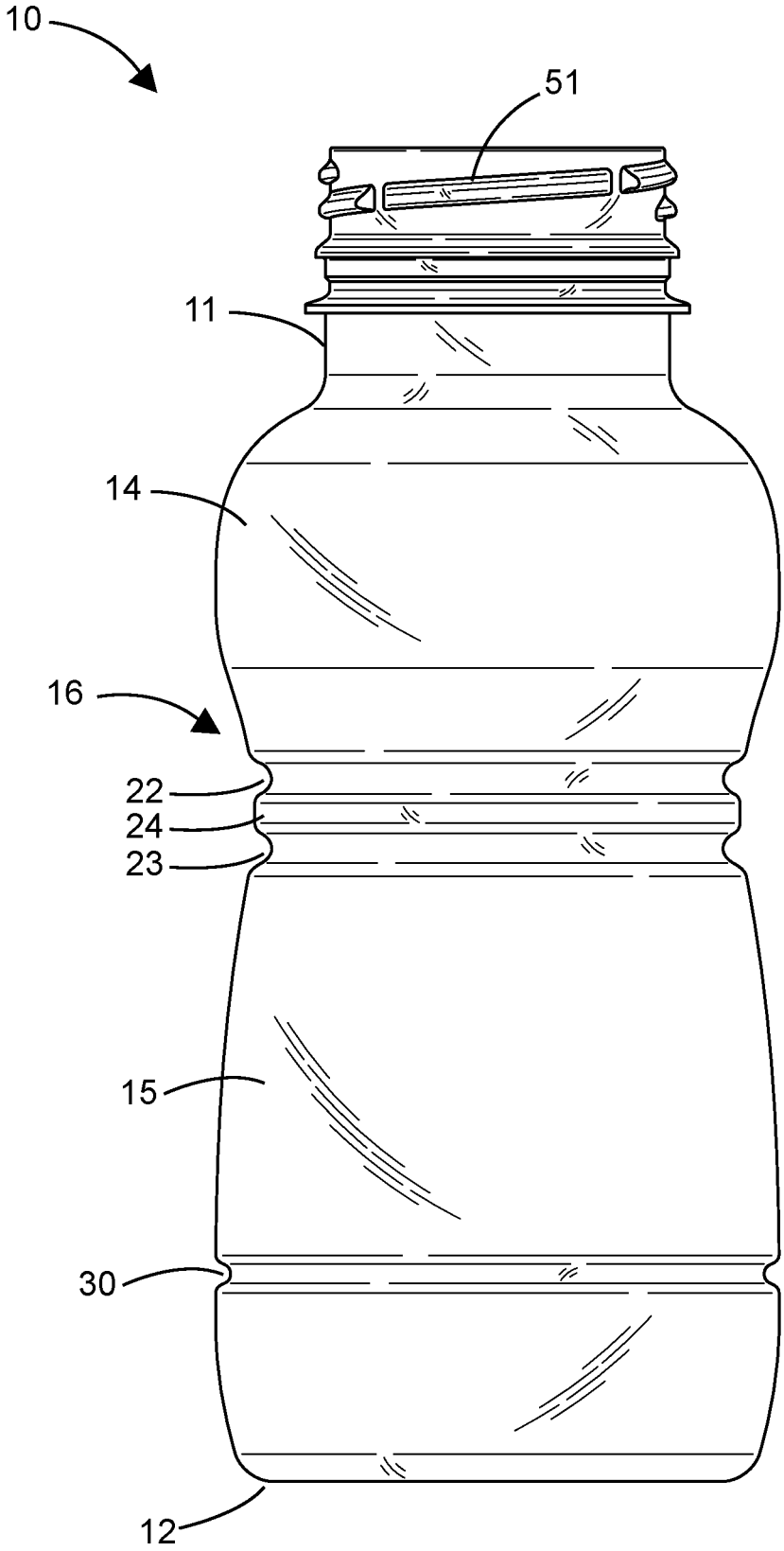
FIG. 6 is a front plan view of the embodiment shown in FIG. 5.
Figure 7:
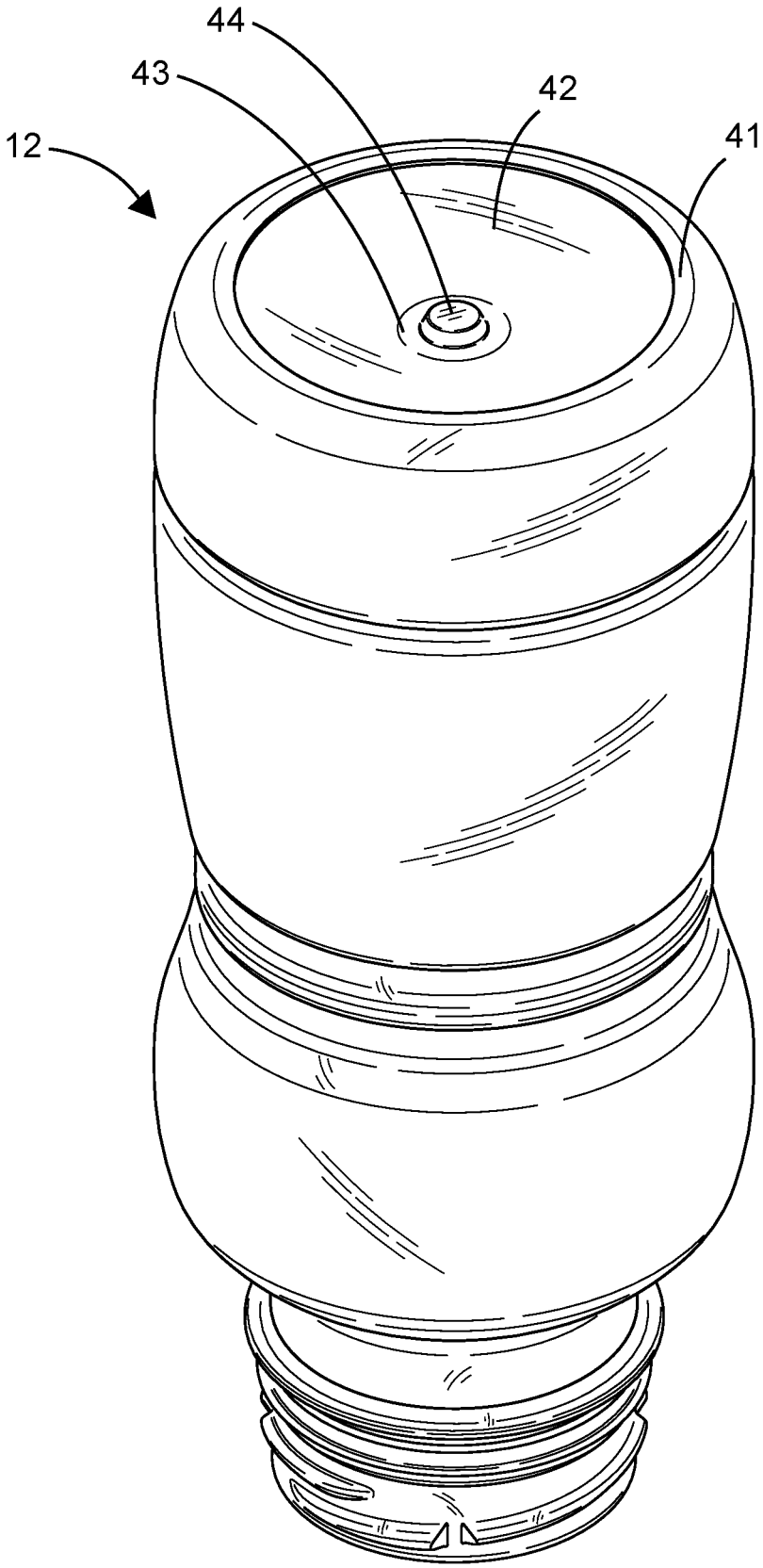
FIG. 7 is a lower perspective view of the embodiment shown in FIG. 5.
Figure 8:
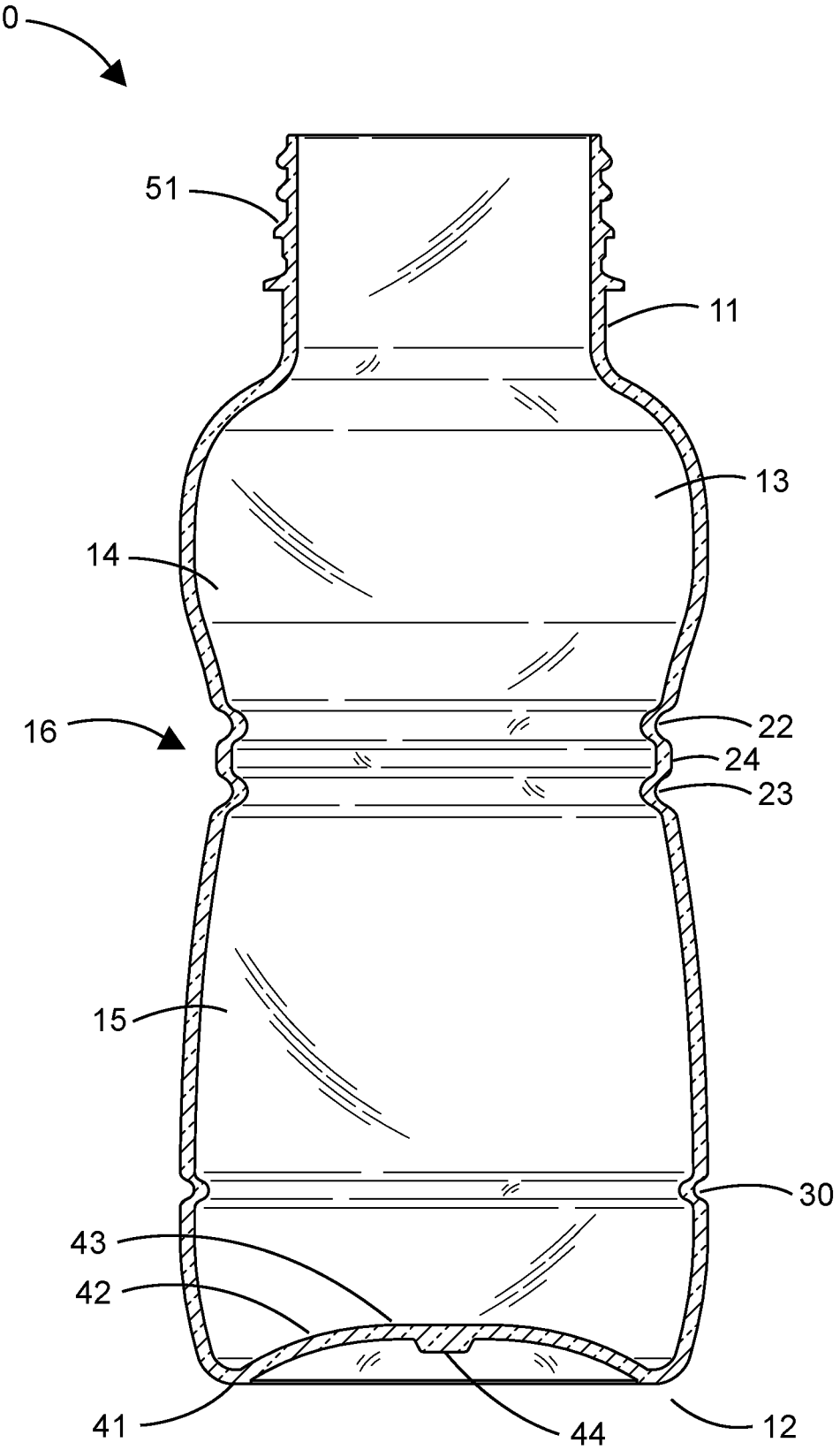
FIG. 8 is a cross-sectional view of the embodiment shown in FIG. 5, taken along the longitudinal axis of the bottle.

As shown in FIG. 6, the first and second circumferential ribs 22, 23 are separated by a land 24. The land 24 may desirably have a relatively short width. For example, in some embodiments the land 24 may have a width between about 3.0 mm and about 6.0 mm, alternatively between about 3.0 mm and about 5.0 mm, alternatively between about 3.0 mm and about 4.0 mm. As shown in the illustrated embodiments, the land 24 may have a planar or substantially planar outer surface. In other (non-illustrated) embodiments, however, the land 24 may have a convexly curved outer surface.

In each of the illustrated embodiments, the panel portion 15 of the sidewall comprises an additional circumferential rib 30. In bottles having smaller internal volumes, the length of the panel portion 15 may be reduced and the additional circumferential rib 30 may be omitted. In bottles having larger internal volumes, the length of the panel portion 15 may be increased and one or more further additional circumferential ribs 30 may be included. Accordingly, embodiments of the bottles 10 may comprise one or more circumferential ribs 30 below the waist.

The circumferential rib 30 on the panel portion 15 is positioned below the waist 16 and, desirably, on the central region of the panel portion 15. For instance, the circumferential rib 30 may be positioned at or near the maximum diameter region of the panel portion 15. In the illustrated embodiments, for example, the circumferential rib 30 is positioned at the region of the panel portion 15 having the maximum panel diameter (specifically, the upper edge of the circumferential rib is at the maximum panel diameter).

The circumferential rib 30 may have a width less than the width of the one or more circumferential ribs 20 positioned at the waist 16, a depth less than the depth of the one or more circumferential ribs positioned at the waist, or both. In the embodiment illustrated in FIGS. 1-4 for example, the circumferential rib 30 on the panel portion 15 of the sidewall 13 has a width that is less than the width of the circumferential rib 21 at the waist 16 and a depth that is less than the depth of the circumferential rib 21 at the waist. Similarly, in the embodiment illustrated in FIGS. 5-8, the circumferential rib 30 on the panel portion 15 of the sidewall 13 has a width that is less than the widths of the first and second circumferential ribs 22, 23 at the waist 16 and a depth that is less than the depths of the first and second circumferential ribs 22, 23 at the waist. In some embodiments, the circumferential rib 30 may have a width less than about 0.15 inches, alternatively less than about 0.12 inches, alternatively less than about 0.10 inches, and a rib depth less than about 0.086 inches, alternatively less than about 0.076 inches, alternatively less than about 0.070 inches.

In those (non-illustrated) embodiments in which an additional, e.g. second, circumferential rib 30 is present, the ribs may have even smaller widths, depths, or both. Desirably, in those embodiments in which two or more circumferential ribs 30 are present, each of the ribs may have substantially the same width and depth.

Apart from the one or more circumferential ribs 20 positioned at the waist 16 and, where present, the one or more circumferential ribs 30 positioned on the panel portion 15 of the sidewall, the sidewall may be free of any additional strengthening features such as additional ribs or vacuum panels. For instance, apart from the single circumferential rib 21 at the waist 16 and the single circumferential rib 30 at the panel portion 15 of the sidewall 13, the sidewall of the bottle illustrated in FIGS. 1 to 4 is free of additional strengthening elements such as ribs or vacuum panels. Similarly, apart from the first and second circumferential ribs 22, 23 at the waist 16 and the single circumferential rib 30 at the panel portion 15 of the sidewall 13, the sidewall of the bottle illustrated in FIGS. 5 to 8 is free of additional strengthening elements such as ribs or vacuum panels.

The base 12 of the bottle may take any of a variety of configurations. In general the base 12 may comprise a standing ring 41 and central push-up portion 42. The standing ring 41 may provide the surface on which the bottle rests when placed in an upright position and is generally thus configured to provide a stable standing surface. The central push-up portion 42 may comprise a surface that curves upward to a recessed portion 43. A gate element 44, which is an outward-extending remnant of the blow-molding process, may be positioned at the center of this recessed portion 43. In some embodiments, including for example the illustrated embodiments, the curved surface of the push-up portion 42 may be smooth, i.e. may contain no ribs or other strengthening features. In other (non-illustrated) embodiments, the curved surface of the push-up portion 42 may comprise any of a variety of strengthening elements as are generally known in the art. For instance, the central push-up portion may comprise a petaloid structure that includes a plurality of insets extending into the interior space of the bottle and which are equally spaced around the circumference of the push-up portion. In some (non-illustrated) embodiments, for example, the petaloid structure may comprise five insets, with the spacings between each set of adjacent insets being substantially identical.

The recessed portion 43 may be positioned at a desired height above the standing ring 41 in order to ensure that, if during the lifespan of the product the internal pressure of the bottle 10 were to exceed the external pressure, the push-up portion may flex downward without the gate element 44 extending beyond the standing ring and thereby causing bottle instability. The height of the recessed portion 43, and hence the steepness of the curved surface of the push-up portion 42 may be selected depending on the potential pressure differentials encountered by the product during its lifespan and the amount of flexing that the push-up portion may undergo in response to those pressure differentials. In some embodiments, including the illustrated embodiments for instance, the recessed portion 43 may be positioned between about 4 mm and about 6 mm upward from the standing ring 41.

The neck portion 11 of the bottle 10 comprises an upper edge that defines an opening to the interior volume of the bottle through which the fluid contents of the bottle may be poured or consumed directly. The outer surface of the neck 11 of the bottle 10 may comprise one or more external threads 51. The one or more external threads 51 may be configured to interact with one or more corresponding internal threads of a removable plastic cap such that the cap may be brought between closed and open positions, as is generally known in the art. In some embodiments, the neck portion 11 of the bottle may also comprise one or more ridges which may interact with one or more tamper-evident elements present on the removable cap, such that the one or more tamper-evident elements of the cap interact with the one or more ridges during a first removal of the cap so as to partially or fully break a connection between the tamper-evident element and the body of the removable cap.

Figure 9:
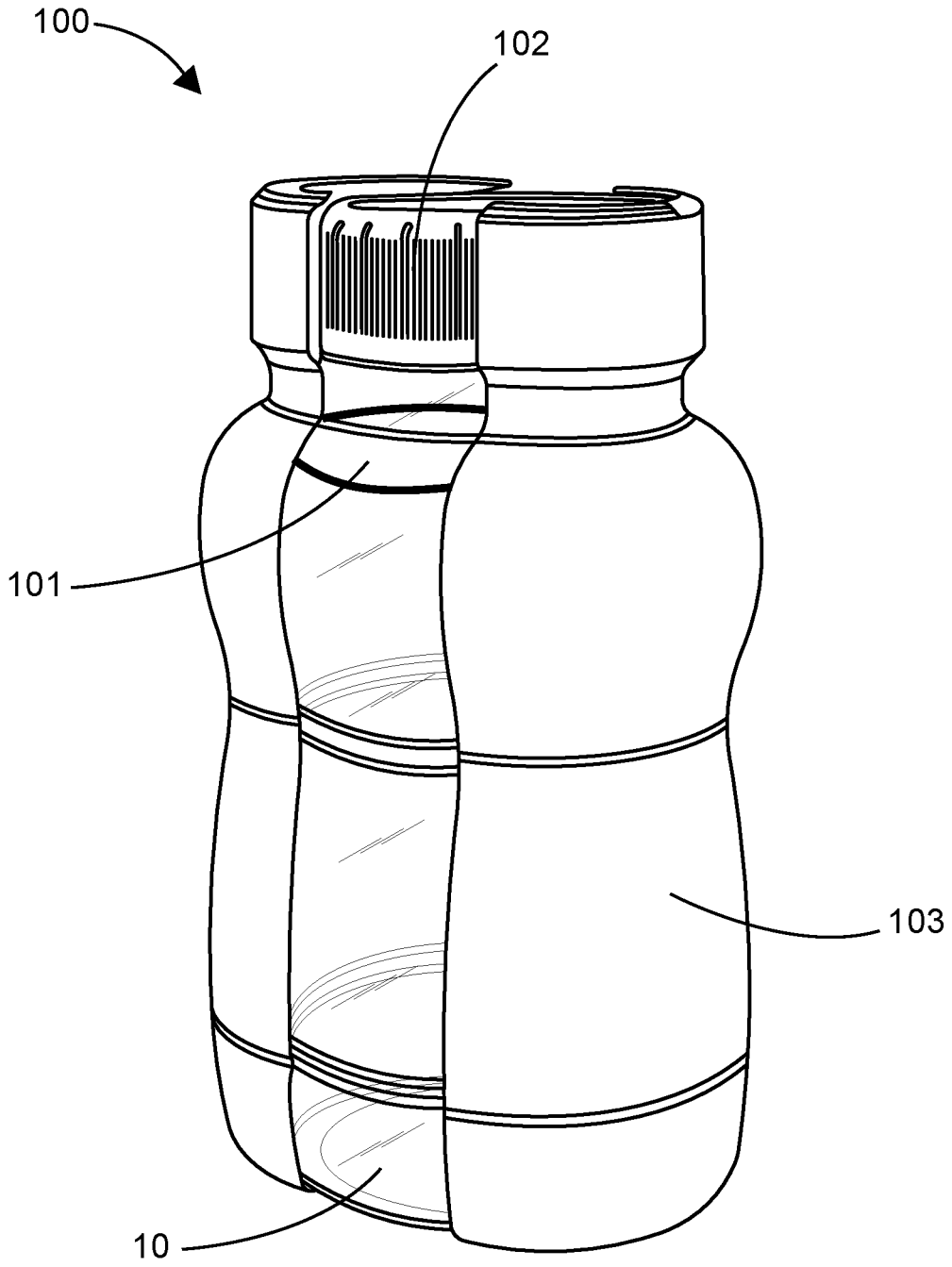
FIG. 9 is a perspective view of an embodiment of a product in accordance with the present disclosure, showing a bottle, removable cap, and shrink sleeve.

Embodiments of the present disclosure are also directed to the a drinkable nutritional product 100, an example of which is shown in FIG. 9. The drinkable nutritional product 100 comprises a PET bottle 10 as described herein, a fluid nutritional product 101 contained within the interior of the bottle 10, and a removable plastic cap 102 that interacts with the neck finish 11 of the bottle to seal the interior space. Desirably, the removable plastic cap 102 interacts with the neck finish 11 of the bottle to provide a liquid-tight and air-tight seal. In some embodiments, the removable plastic cap 102 may also comprise a knurl pattern on the exterior of the sidewall, which may assist a user in gripping and rotating the cap. The removable plastic cap may be made of plastic and is desirably recyclable. In some embodiments, for instance, the removable plastic cap may be made of high-density polyethylene (HDPE).

In some embodiments, the fluid nutritional product 101 may be present within the bottle 10 in an amount between about 6 ounces and about 11 ounces, including for example 6 ounces, 8 ounces, 10 ounces, or 11 ounces, depending on the specific product fill volume of the bottle.

In some embodiments, the product 100 may also comprise a shrink sleeve label 103 that surrounds the sidewall 13 of the bottle 10. The shrink sleeve label 103 may cover the entirety of the sidewall 13 of the bottle. In some embodiments, the shrink sleeve label 103 may further cover the outer side surface of the reclosable cap 102, whereby it may act as a tamper-evident element, since a consumer will have to at least partially remove the shrink sleeve label in order to remove the cap and access the interior contents of the bottle. In addition to providing information regarding the fluid nutritional product present within the bottle 10, the shrink sleeve label 103 may also protect the fluid content of the bottle from light deterioration. In some embodiments, for instance, the fluid nutritional product 101 may be sensitive to light. As the PET bottle 10 may be transparent, the bottle itself may provide little protection for the fluid contents against external light. Accordingly, in some embodiments, the shrink sleeve label 103 may be configured to block light from entering the interior of the bottle through the transparent sidewall 13. For example, the shrink sleeve label 103 may comprise one or more light-blocking layers or inks.

As described above, the one or more circumferential ribs 20 that are positioned within the waist 16 of the bottle may be configured to provide the bottle 10 with improved vacuum stability and hoop strength. The below examples show the testing procedures that are used to determine the vacuum stability of the bottle 10 and the hoop strength of the bottle. The also demonstrate an exemplary procedure for the development of bottles having one or more circumferential ribs 20 that are configured to provide a bottle having a desired vacuum stability and hoop strength.

Example 1—Vacuum Stability Testing

Embodiments of the present bottles were tested for vacuum stability. Long-term vacuum stability of a bottle is important in order to ensure that the bottles are capable of maintaining their shape over the shelf-life of a product, during which moisture will bleed through the PET walls of the bottle causing an internal vacuum to form. In this example, a long-term vacuum safety factor was determined. In order to define the vacuum safety factor, one must first assign a timeframe, e.g. an estimated shelf life of the commercial product. Here, the timeframe was set at 15 months or 18 months. Second, the level of deformation that would be considered unacceptable in a commercial product must be assigned. Here, a 0.1 inch ovality was determined to be an unacceptable level of deformation, meaning that if the diameter at the bottle decreased (e.g. the bottle buckled) by 0.1 inch or more in at least one direction, such that the bottle no longer maintained a circular cross-sectional shape, the product would be unacceptable. The vacuum safety factor that is the subject of the testing in this example therefore determines whether, at the expected vacuum that would be created inside the bottle at the end of the 15 or 18 month shelf life, the bottle would deform by 0.1 inches or more.

Given that 15-18 months is not a very practical period for testing purposes, sample bottles were tested for short-term vacuum stability and then the long-term vacuum stability of those bottles were extrapolated from the short-term vacuum stability testing. In order to do so, however, a number of factors need to be taken into account. One factor is creep of the PET material, which reduces the strength of the PET material, and thus the ability of the bottle wall to withstand pressure before buckling. Another factor is the water vapor transmission rate (WVTR) of the PET material itself, which is the rate at which moisture will pass through the walls of the bottle.

In order to take into account the weakening of the bottle walls due to creep over the assigned shelf life of the bottle, one may either utilize industry standard tensile creep data, which is routinely published for PET and other common materials, or one may calculate it by maintaining a defined vacuum into the bottle and measuring the deformation of the bottle wall over time. In the present example, sample bottles, each of which has an eight-ounce product fill volume, were filled with eight ounces (specifically 237 mL) of water at room temperature and each bottle was provided with an internal vacuum of either 1.0 psig or 2.0 psig. After about 24 hours, the internal vacuum in each bottle was reduced by 0.25 psig, i.e., to either 0.75 psig or 1.75 psig, and maintained at that level for forty days. The bottle was placed between two Starrett brand dial indicators, which measured the bottle minimum diameter and the bottle maximum diameter at the waist (the two measurements indicating the ovality of the bottle). The interior of the bottles were also connected to a vacuum gauge and the internal volume of the bottle was recorded each time the bottle ovality was measured. Those measurements were taken at numerous points throughout the forty day test period, and the creep of the bottle material was determined from the results.

Rather than test the specific WVTR of the bottles, in the present example, a WVTR of 0.0185 g/pkg-day was assigned. This value is believed to be a good deal higher than the actual WVTR of the bottle (which is expected to be closer to 0.011), meaning that the safety factors determined in this example are conservative and that the actual safety factors for the bottles are expected to be higher than those reported.

Four bottle types were tested:

1. an eight ounce bottle having a single circumferential rib—rib width of 0.08 inches, rib depth of 0.064 inches—at the trough of the waist (single rib A);
2. an eight ounce bottle having a single circumferential rib of increased dimensions relative to the A bottle—specifically a rib width of 0.12 inches, rib depth of 0.076 inches—at the trough of the waist (single rib B);
3. an eight ounce bottle having a single circumferential rib of increased dimensions relative to the B bottle—specifically a rib width of 0.15 inches, rib depth of 0.086 inches—at the trough of the waist (single rib C); and
4. an eight ounce bottle having two circumferential ribs—each rib having a width of 0.12 inches and a depth of 0.076 inches—at the trough of the waist (double rib).

The dimensions of the ribs for each of the tested bottles are shown in Table 1.

TABLE 1

| Bottle Type | Rib Width (in) | Rib Depth (in) | Volume Reduction relative to Single Rib A (mL) |
|---|---|---|---|
| Single Rib A | 0.08 | 0.064 | 0.00 |
| Single Rib B | 0.12 | 0.076 | 0.34 |
| Single Rib C | 0.15 | 0.086 | 0.63 |
| Double Rib | 0.12 (each) | 0.076 (each) | 1.37 |

Each bottle type was tested to determine what level of internal pressure would cause deformation of the bottle that resulted in a 0.1 inch ovality. The ovality of the bottles was tested as described above, i.e. the bottle was placed between two Starrett brand dial indicators, which measured the bottle minimum diameter and the bottle maximum diameter at the waist (the two measurements indicating the ovality of the bottle). That testing was performed at room temperature by sealing the bottle with a cap containing a vacuum pump and increasing the vacuum within the sealed bottle at a gradual rate (measuring after each increase) until the requisite deformation occurs. When a 0.1 inch ovality deformation was been detected, the level of the vacuum was recorded. The results of that testing are shown in Tables 2 and 3 at the columns labeled "Vacuum at 0.1 inch Ovality or Buckling (psig)". By taking into account the creep of the bottle wall (measured as described above), the pressure that would cause a 0.1 inch ovality deformation after a 15 or 18 month time period was then extrapolated from the short-term test results. Those values are shown in Tables 2 and 3 at the columns labeled "15-Month Vacuum at 0.1 inch Bottle Ovality or Buckling (psig)" and "18-Month Vacuum at 0.1 inch Bottle Ovality or Buckling (psig)"

The amount of vacuum that would be formed within the bottle after 15 or 18 months was calculated using the WVTR (here, the conservatively estimated WVTR) of the bottle material. Those values are shown in Tables 2 and 3 at the columns labeled "15-Month Bottle Vacuum (psig)" and "18-Month Bottle Vacuum (psig)."

The vacuum safety factor was thus determined by dividing the vacuum (in psig) required to produce a 0.1 inch ovality deformation by the vacuum (in psig) that would be formed in the bottle after the identified time period of 15 or 18 months, e.g. dividing the values in column "15-Month Vacuum at 0.1 inch Bottle Ovality or Buckling (psig)" by the values in column "15-Month Bottle Vacuum (psig)". A vacuum safety factor greater than one means that the bottle is configured to withstand the internal vacuum that will be created within the bottle over the identified shelf life. A vacuum safety factor less than one means that the bottle is likely to have unacceptable deformation over the identified shelf life of the commercial product. The results of the testing are shown in Tables 2 and 3.

TABLE 2

| Bottle Design | Vacuum at 0.1 inch Ovality or Buckling (psig) | 15-Month Bottle Vacuum (psig) | 15-Month Vacuum at 0.1 inch Ovality or Buckling (psig) | Vacuum Safety Factor (15-Month) |
|---|---|---|---|---|
| Single rib A | 2.4 | 1.65 | 1.38 | 0.84 |
| Single rib C | 5.7 | 2.66 | 3.18 | 1.20 |
| Double rib | 7.4 | 2.61 | 4.11 | 1.57 |

TABLE 3

| Bottle Design | Vacuum at 0.1 inch Ovality or Buckling (psig) | 18-Month Bottle Vacuum (psig) | 18-Month Vacuum at 0.1 inch Ovality or Buckling (psig) | Vacuum Safety Factor (18-Month) |
|---|---|---|---|---|
| Single rib A | 2.4 | 1.65 | 1.37 | 0.83 |
| Single rib B | 3.9 | 2.39 | 2.10 | 0.88 |
| Single rib C | 5.7 | 2.99 | 3.14 | 1.05 |
| Double rib | 7.4 | 2.94 | 4.06 | 1.38 |

This testing demonstrates that the geometry of the rib, e.g. rib width and rib diameter, are important to obtaining a monolayer PET bottle having the waisted geometry shown herein that is capable of withstanding internal vacuum forces that may occur over an extended shelf-life. Both the single rib A bottle, which contained a rib having the smallest dimensions, and the single rib B bottle, which contained a rib having the next smallest dimensions, provided a safety factor of less than 1.0 for the identified 15 month and 18 month shelf lives. Notably, the single rib C bottle, which contained a larger rib than the single rib A and single rib B bottles, provided safety factors above 1.0 for each of the identified 15-month and 18-month shelf life. Similarly, the double-rib bottle provided safety factors well above 1.0 for each of the identified 15-month and 18-month shelf life.

Embodiments of the present disclosure are directed to a waisted bottle having one or more ribs at the trough of the waist, and preferably a single rib, the one or more ribs, and preferably a single rib, being configured to provide the bottle with a 15-month vacuum safety factor greater than 1.0, optionally a 15-month vacuum safety factor of at least 1.05, optionally at least 1.10, optionally at least 1.15, optionally at least 1.20. Similarly, embodiments of the present disclosure are directed to a waisted bottle having one or more ribs at the trough of the waist, and preferably a single rib, the one or more ribs, and preferably a single rib, being configured to provide the bottle with an 18-month vacuum safety factor greater than 1.0, optionally an 18-month vacuum safety factor of at least 1.05, optionally at least 1.10, optionally at least 1.15, optionally at least 1.20. Each of these vacuum safety factors may be determined at room temperature and standard atmospheric external pressure (~1 atm). Further, in some embodiments, each of these vacuum safety factors can be calculated using either a calculated WVTR transmission rate of the bottle or a conservatively selected rate that is higher than the actual WVTR transmission rate of the bottle, such as a WVTR of 0.0185 g/pkg-day.

Example 2—Hoop Strength Testing

Embodiments of the present bottles were tested for hoop strength using an axial compression test procedure. In particular the hoop strength of the bottle at the trough of the waist where the rib or ribs are located, which being the lowest diameter portion of the bottle is a natural location for ovalization to occur was tested. Three bottle types were tested:

1. an eight ounce bottle having a single circumferential rib with a rib width of 0.15 inches and a rib depth of 0.086 inches at the trough of the waist (identified in the previous example as the "single rib C" bottle);
2. an eight ounce bottle having two circumferential ribs—each rib having a width of 0.12 inches and a depth of 0.076 inches—at the trough of the waist (identified in the previous example as the "double rib" bottle)
3. a control eight ounce bottle, which did not contain any rib (control).

Note that though the geometry of the control was not identical to that of bottle type 1 or bottle type 2, it was considered sufficiently close to provide a reasonable value as to the hoop strength of a bottle having a similar central waist and containing no strengthening ribs. Five samples of each bottle type were tested and the results averaged.

Figure 10:
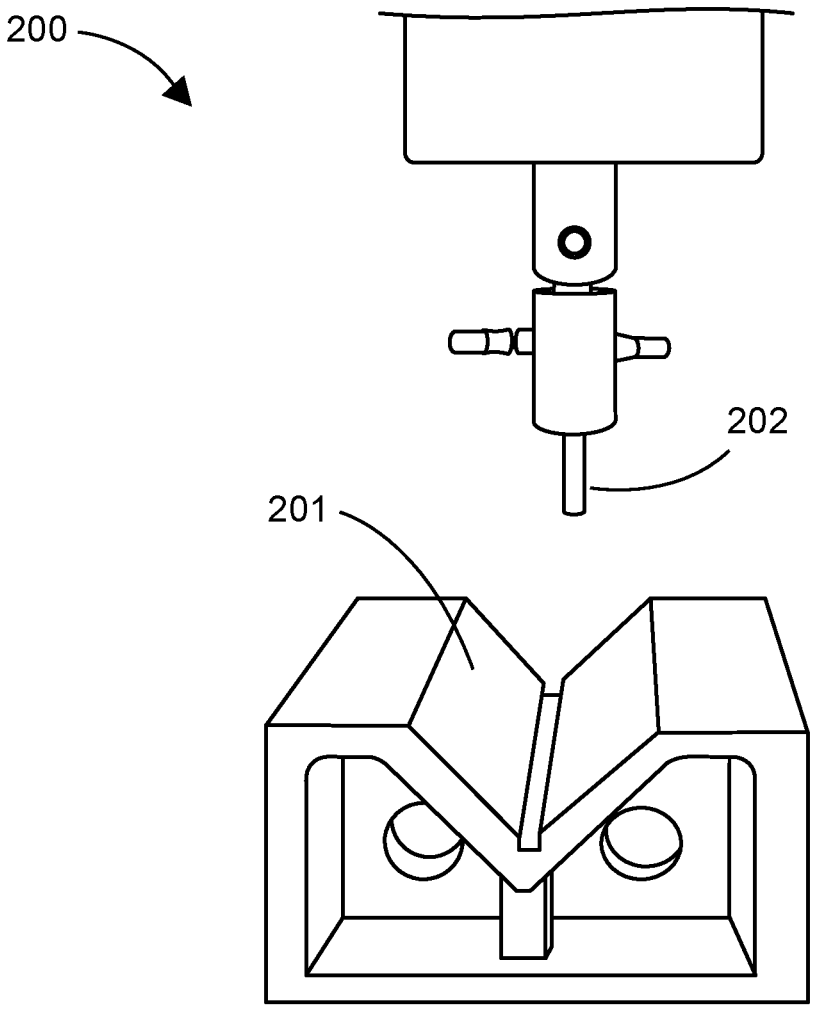
FIG. 10 is a front view of a system for testing the hoop strength of a bottle in accordance with an embodiment of the present disclosure.
Figure 11:
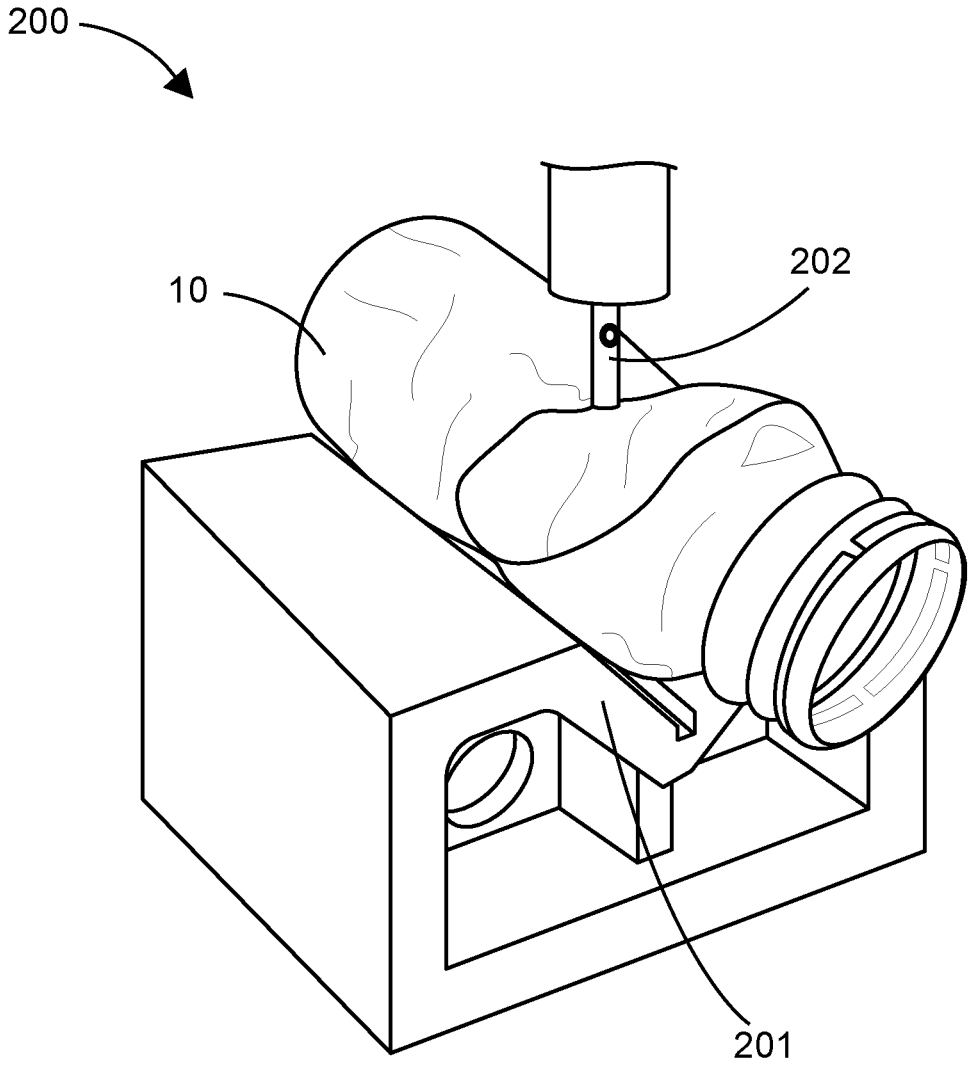
FIG. 11 is a front, perspective view of the system shown in FIG. 10, showing a bottle being tested.

The test was performed using the system 200 illustrated in FIGS. 10-11. The system included a V-shaped cradle 201 which was configured to contact and support the bottles 10 along a side region while leaving the upper and lower faces of the bottle free. The system also included an Instrom 5582 (controlled via Bluehill Universal software v4.28), with a point load fixture 202 having a diameter of 5.75 mm and a length of 19.5 mm. The small diameter of the fixture 202 allows the load to be directly applied into the waist region 16 of the sidewall 13 of the bottle with minimal distribution to the upper and lower sections of the bottle sidewall. The system 200 is configured for the point load fixture 202 to apply a uniform load at a constant speed. The system 200 is also configured to detect the force applied, and thereby identify when a drop in the force occurs, which is indicative of bottle deformation, i.e., buckling.

Each bottle 10 was placed in the V-shaped cradle 201, with the waist portion 16 substantially centered. The fixture 202 was then lowered until it contacted the bottle at a center of the waist 16. The double rib bottles 10 were loaded along the central land 24 between the two ribs 22,23, so that the force would be evenly distributed over both ribs. For the single rib bottles 10, the load was applied directly to the rib 21. The load was applied at a rate of one inch per minute. The system 200 was programmed to apply the load until a drop in force of 5% or more was detected, which was determined to reflect a significant buckling event. When such a drop in force was detected, the point load fixture 202 would stop moving. The maximum load was then recorded (in pound-force, lbf), as was the amount of deformation, i.e., inward buckling (in inches), of the hoop (i.e. the bottle sidewall 13) at that maximum load. The results for the five samples of each bottle type were then averaged.

The results are shown in Table 4.

TABLE 4

| Bottle Type | Maximum Load (lbf) | Deformation (in) |
|---|---|---|
| Bottle Type 1 (single rib) | 27.7 | 0.4 |
| Bottle Type 2 (double rib) | 38.4 | 0.7 |
| Control (no rib) | 11.9 | 0.4 |

The results demonstrated that the bottles 10 having the double rib 22, 23 were able to withstand the highest load (38.4 pounds of force) before significant deformation. Notably, however, the bottles 10 having the single rib 21 were able to withstand about 28 pounds of force before significant deformation, which was more than double that of the rib-less control bottles.

Though the above test results were obtained using an eight ounce bottle 10, it is contemplated that similar results could be obtained on bottles of greater or smaller volumes in which the waist geometry and the rib geometry were substantially the same. For instance, it is contemplated that the above test results may also apply for a six ounce bottle in which the panel portion of the bottle was shorter in a longitudinal direction (but the shoulder and waist portions remained substantially the same), for a ten ounce bottle in which the panel portion of the bottle was taller in a longitudinal direction (but the shoulder and waist portions remained substantially the same), etc.

Embodiments of the presently disclosed bottle 10 may have a waist hoop strength of at least 15.0 lbf, i.e., withstand a load of at least 15.0 lbf before buckling, as may be measured in accordance with the above test method, alternatively at least 17.5 lbf, alternatively at least 20.0 lbf, alternatively at least 22.5 lbf, alternatively at least 25.0 lbf, alternatively at least 27.5 lbf. Notably, these improvements in waist hoop strength may be obtained using a single rib positioned at the center of the waist, which provides significant additional advantages over bottles having a plurality of ribs.

In other embodiments, a bottle 10 in which the waist comprises first and second ribs 22, 23 separated by a short land 24 may have a waist hoop strength of at least 25.0 lbf, i.e., withstand a load of at least 25.0 lbf measured using the above test protocol, alternatively at least 27.5 lbf, alternatively at least 30.0 lbf, alternatively at least 32.5 lbf, alternatively at least 35.0 lbf, alternatively at least 37.5 lbf.

It can be seen that the described embodiments provide unique and novel bottles 10 that have a number of advantages over those in the art. While there is shown and described herein certain specific structures embodying the invention, it will be manifest to those skilled in the art that various modifications may be made without departing from the spirit and scope of the underlying inventive concept and that the same is not limited to the particular embodiments herein shown and described except insofar as indicated by the scope of the appended claims.

What is claimed is:

1. A polyethylene terephthalate (PET) bottle comprising
a neck finish;
a base;
a rounded sidewall spanning between the neck finish and the base, the sidewall comprising a shoulder portion and a panel portion, a lower end of the shoulder portion and an upper end of the panel portion each sloping inward to create a waist;
a single circumferential rib positioned in the waist, the circumferential rib being positioned at a trough of the waist, and the circumferential rib being configured to increase the hoop strength and the vacuum stability of the bottle;
wherein the circumferential rib has a width between 0.13 and 0.22 inches and a depth between 0.080 and 0.110 inches;
wherein the panel portion comprises one or more circumferential ribs below the waist; and
wherein each of the one or more circumferential ribs below the waist has a rib width less than the rib width of the circumferential rib positioned at the trough of the waist, a rib depth less than the rib depth of the circumferential rib positioned at the trough of the waist, or both.

2. The PET bottle of claim 1, wherein the circumferential rib has a width between 0.15 and 0.20 inches and a depth between 0.082 inches and 0.090 inches.

3. The PET bottle of claim 1, wherein the bottle has a 15-month vacuum safety factor greater than 1.0.

4. The PET bottle of claim 1, wherein the bottle has an 18-month vacuum safety factor greater than 1.0.

5. The PET bottle of claim 1, wherein the bottle has a waist hoop strength of at least 15.0 lbf.

6. The PET bottle of claim 1, wherein the PET bottle is a monolayer PET bottle.

7. The PET bottle of claim 6, wherein the monolayer comprises an oxygen scavenger in an amount between 1% and 4% of the total weight of the PET.

8. The PET bottle of claim 1, wherein the bottle has a product fill volume between six ounces and eleven ounces.

9. The PET bottle of claim 1, wherein the bottle has a weight between 16 g and 21 g.

10. The PET bottle of claim 1, wherein the sidewall has an average thickness between 0.008 inches and 0.016 inches.

11. The PET bottle of claim 1, wherein the PET bottle has a water vapor transmission rate less than 0.0185 g/pkg-day.

12. The PET bottle of claim 1, wherein the PET bottle has a maximum diameter and wherein each of the shoulder portion and the panel portion both extend to the maximum diameter.

13. The PET bottle of claim 1, wherein the panel portion has a single circumferential rib below the waist.

14. The PET bottle of claim 1, wherein each of the one or more circumferential ribs below the waist has a rib width less than 0.15 inches, and a rib depth less than 0.086 inches.

15. The PET bottle of claim 1, wherein apart from the circumferential rib positioned at the trough of the waist and the one or more circumferential ribs on the panel portion below the waist, the sidewall is free of additional ribs or vacuum panels.

16. The PET bottle of claim 1, further comprising a removable plastic cap and a shrink sleeve label, the shrink sleeve label covering an entirety of the bottle sidewall.

17. The PET bottle of claim 16, wherein the shrink sleeve label is configured to protect a content of the bottle from light.

18. A product comprising:
the PET bottle of claim 1;
a fluid nutritional product within the bottle;
a removable plastic cap, the removable plastic cap forming an air-tight seal with the finish of the PET bottle; and
a shrink sleeve label configured to protect the fluid nutritional product from light.

* * * * *